US009017040B2

(12) United States Patent
Birch

(10) Patent No.: US 9,017,040 B2
(45) Date of Patent: Apr. 28, 2015

(54) ROUGHING PUMP METHOD FOR A POSITIVE DISPLACEMENT PUMP

(75) Inventor: Peter Birch, West Sussex (GB)

(73) Assignee: Oerlikon Leybold Vacuum GmbH, Cologne (DE)

( * ) Notice: Subject to any disclaimer, the term of this patent is extended or adjusted under 35 U.S.C. 154(b) by 621 days.

(21) Appl. No.: 13/264,815

(22) PCT Filed: Apr. 16, 2010

(86) PCT No.: PCT/EP2010/055043
§ 371 (c)(1), (2), (4) Date: Dec. 1, 2011

(87) PCT Pub. No.: WO2010/119121
PCT Pub. Date: Oct. 21, 2010

(65) Prior Publication Data
US 2012/0063917 A1 Mar. 15, 2012

(30) Foreign Application Priority Data
Apr. 17, 2009 (DE) ..... 10 2009 017 887

(51) Int. Cl.
*F04B 49/20* (2006.01)
*F04C 28/08* (2006.01)
*F04C 18/12* (2006.01)

(52) U.S. Cl.
CPC ..... *F04B 49/20* (2013.01); *F04C 18/123* (2013.01); *F04C 28/08* (2013.01); *F04C 2240/40* (2013.01); *F04C 2270/02* (2013.01)

(58) Field of Classification Search
USPC ..... 417/53, 302, 42, 44.2, 45, 410.3, 410.4; 137/565.23, 14, 565.29, 565.3; 700/282
See application file for complete search history.

(56) References Cited

U.S. PATENT DOCUMENTS

| | | | | |
|---|---|---|---|---|
| 4,664,601 | A | 5/1987 | Uchida et al. | |
| 4,770,609 | A * | 9/1988 | Uchida et al. | 417/2 |
| 4,808,095 | A * | 2/1989 | Nishitani et al. | 418/15 |
| 5,674,063 | A | 10/1997 | Ozaki et al. | |
| 5,746,581 | A * | 5/1998 | Okumura et al. | 417/2 |
| 6,200,107 | B1 * | 3/2001 | Brewster | 417/251 |
| 6,354,805 | B1 | 3/2002 | Moeller | |
| 7,621,721 | B2 | 11/2009 | Carboneri et al. | |
| 7,814,922 | B2 * | 10/2010 | Tollner | 137/12 |
| 8,070,459 | B2 * | 12/2011 | Tollner | 417/53 |
| 2002/0159898 | A1 | 10/2002 | Rajendran et al. | |
| 2005/0031468 | A1 * | 2/2005 | Kawaguchi et al. | 417/410.1 |

FOREIGN PATENT DOCUMENTS

| | | | |
|---|---|---|---|
| DE | 3711143 | A1 | 10/1987 |
| DE | 19630384 | A1 | 4/1998 |
| DE | 19931961 | A1 | 2/2001 |

(Continued)

*Primary Examiner* — Charles Freay
(74) *Attorney, Agent, or Firm* — Fay Sharpe LLP

(57) ABSTRACT

In order to provide a simple and energy-efficient rough pumping method for a displacement pump (10), intended to generate a maximum differential pressure ($\Delta P_{max}$) between the inlet (18) and the outlet (20) of the displacement pump (10), the rotational speed ($\Omega$) of the displacement pump (10) is adjusted such that the maximum differential pressure ($\Delta P_{max}$) to be generated that the power input (3, 4) of the displacement pump (10) approximates the minimum power (2) physically required for compressing the gas in order to establish the maximum differential pressure ($\Delta P_{max}$).

23 Claims, 1 Drawing Sheet

FOREIGN PATENT DOCUMENTS

| | | | |
|---|---|---|---|
| DE | 69525550 | T2 | 8/2002 |
| DE | 602004007325 | T2 | 3/2008 |
| EP | 1467100 | A2 | 10/2004 |
| JP | 2007239639 | A | 9/2007 |

* cited by examiner

ROUGHING PUMP METHOD FOR A POSITIVE DISPLACEMENT PUMP

BACKGROUND

The invention is directed to a rough pumping method for a displacement pump as well as to a displacement pump device for establishing a rough differential pressure.

In the present context, a rough differential pressure is understood to be a negative differential pressure in the sense of a rough vacuum or a positive differential pressure in the sense of an application of rough pressure. A typical rough vacuum has a magnitude of up to 500 mbar of differential pressure and typically ranges from 100 to 300 mbar of differential pressure. For a large variety of applications there is a great need for rough vacuum pumps that are mostly designed as single-shaft centrifugal compressors or as side channel blowers. Side channel blowers have a defined volume flow capacity and must continually be operated at a continuously high rotational speed. They operate based on the principle of torque transmission according to Euler's energy equation for compressible fluids. For the generation of a correspondingly low volume flow, side channel blowers must be operated at their full volume flow capacity, even if a large differential pressure exists between the inlet and the outlet of the compressor or blower. The power required by the compressor is proportional to the volume flow capacity, the theoretically required minimum power for compressing and transporting a small gas flow being proportional to the actual volume flow capacity. Due to this difference between the actual power output and the power physically required for compressing the gas, the use of such conventional rough vacuum compressors is inefficient.

Displacement pumps, such as a Roots pump, for example, are particular effective in maintaining low pressures with no large volume flows being conveyed, or in generating small differential pressures. For generating a rough vacuum with a large differential pressure, displacement pumps, such as Roots pumps, for example, are presently not employed.

SUMMARY

It is an object of the present invention to provide a simple and energy-efficient rough pumping method as well as a corresponding rough pumping device.

The present application discloses a rough pumping method for a displacement pump, intended to generate a differential pressure between the inlet and the outlet of the displacement pump. The rotational speed of the displacement pump is adjusted such to the maximum differential pressure to be generated that the power input of the displacement pump approximates the minimum power physically required for compressing the gas and for generating the differential pressure. A displacement pump is advantageous over a conventional rough vacuum pump, such as a side channel blower, for example, in that the pumping power can be varied by varying the rotational speed or the piston stroke, respectively. Reducing the rotational speed allows to reduce the pressure generated and the power input of the displacement pump. The displacement pump is designed such that its maximum power input at maximum rotational speed is higher than the minimum power theoretically required for compressing the gas in order to establish a desired differential pressure. In other words, the pump is inherently capable of a greater pressure difference. Here, the differential pressure generated by the pump can be reduced such by reducing the rotational speed of the displacement pump, that the power input of the pump approximates the minimum power for compressing the gas. Adjusting the power input to the power required for compressing the gas is only possible with electronically controlled displacement pumps, however, not with conventional side channel blowers. A displacement pump allows to convey a contained gas volume from the pump inlet to the pump outlet at a variable rotational speed.

Preferably, the rotational speed is set using the relationship $$\Omega = \frac{C_l}{V_S}\left(\frac{P_{out}}{P_{in,min}} - 1\right)\Omega_{max}$$

in the no-flow condition, where $V_S$ is the compressor swept capacity of the displacement pump, $C_I$ is the back-leakage conductance within the pump, $P_{out}$ is the outlet pressure of the displacement pump, $P_{in,min}$ is the minimum inlet pressure of the displacement pump that is to be generated, $\Delta P_{max}=P_{out}-P_{in,min}$, and $\Omega_{max}$ is the maximum rotational speed of the displacement pump with $\Omega<\Omega_{max}$.

The rough differential pressure $\Delta P_{max}$ to be set can be in a range of up to −500 mbar or up to +500 mbar. In particular, a typical rough differential pressure is in a range from ±200 to ±400 mbar.

Preferably, the torque T of the pump drive is reduced as the differential pressure ΔP between the outlet pressure $P_{out}$ and the inlet pressure $P_{in}$ rises and the pump rotational speed increases. The torque is reduced above a rotational speed threshold $\Omega_{v/f}$, up to which preferably a constant torque prevails. The rotational speed threshold $\Omega_{v/f}$ should be ≥0 and should preferably be below 30 Hz. Preferably, the torque decreases linearly above the rotational speed threshold $\Omega_{v/f}$ over the differential pressure. In an electric motor, such a reduction of the torque can be achieved using an electronic inverter, where the rotational speed threshold $\Omega_{v/f}$ should be chosen as small as possible. With an electronic inverter, it is possible to reach a rotational speed threshold $\Omega_{v/f}$ of 10 Hz. A reduction of the torque as the differential pressure increases is advantageous because the torque T according to the formula $$T = \frac{V_S}{\Omega_{max}} \cdot (P_{out} - P_{in})/36,$$

where $V_S$ is the volume flow capacity, $\Omega_{max}$ is the maximum rotational speed of the displacement pump, $P_{out}$ is the outlet pressure and $P_{in}$ is the inlet pressure, depends on the inlet pressure. In other words: only a certain torque is needed to reach a certain inlet pressure $P_{in}$. Since the power P is the product of the torque T and the rotational speed Ω, the power depends on the pump rotational speed. The minimum inlet pressure $P_{in,min}$ to be established is to be reached at the lowest rotational speed Ω possible in order to minimize the pump power to be applied.

The displacement pump device of the present invention comprises not only a displacement pump, but a pump drive and a control means for reducing the rotational speed of the displacement pump. The displacement pump device preferably comprises a memory for the differential pressure $\Delta P_{imax}$ to be achieved, which memory is a part of the control means. In particular, the memory contains a program for adjusting the rotational speed Ω.

The pump drive preferably is an electric motor and the control means may be an electric inverter in this case. The electric motor may be an induction motor, a reluctance motor or a brushless DC motor. The displacement pump preferably is a Roots pump or, alternatively, a claw screw pump or a dry-running rotary vane pump. The displacement pump may be of single-stage or multistage design, where the multiple stages may have different displacing capacities. The displacement pump may be air-cooled or liquid-cooled, e.g. by water or oil.

BRIEF DESCRIPTION OF THE DRAWINGS

The invention is set forth in greater detail in the following description, including reference to the accompanying drawing in which.

DETAILED DESCRIPTION

Figure 1:
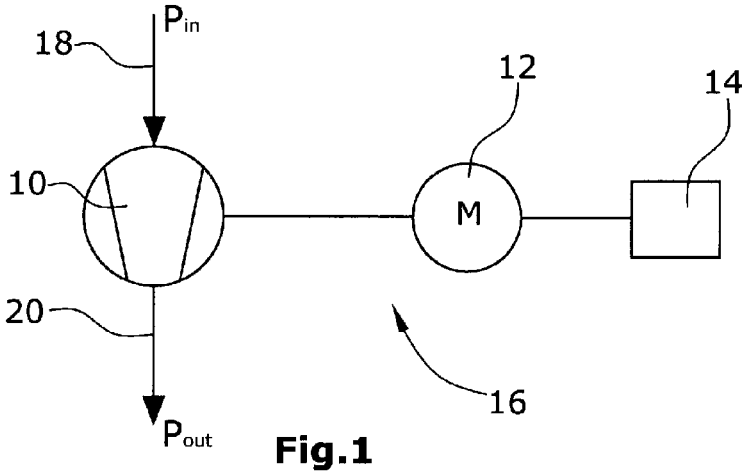
FIG. 1 shows a block diagram of a displacement pump device according to a first embodiment.

The displacement pump device 16 illustrated in FIG. 1 is formed by a displacement pump 10, a pump drive 12 for the displacement pump 10 and a control means 14 connected to the pump drive 12. The displacement pump 10 is a Roots pump and the pump drive 12 is an electric motor. The control means 14 is an electronic inverter with which the rotational speed of the pump drive 12 and the displacement pump 10 may be set.

At the suction-side inlet 18 of the displacement pump 10, an inlet pressure $P_{in}$ prevails in the suction channel of the pump. At the pressure-side outlet 20 of the displacement pump 10, an outlet pressure $P_{out}$ prevails in the outlet channel of the displacement pump 10. As will be described hereunder with reference to FIG. 2, the displacement pump 10 is over-capable for the prevailing pressures $P_{in}$ and $P_{out}$ and for the resulting differential pressure $\Delta P_{max}=P_{out}-P_{in}$, so that, by reducing the rotational speed of the pump drive 12 and the displacement pump 10 by means of the control means 14, the power input 3, 4 of the pump approximates the minimum power 2 required for compressing the gas in order to establish the differential pressure $\Delta P_{max}$. Over-capable means that the pump is capable of a greater pressure difference.

Figure 2:
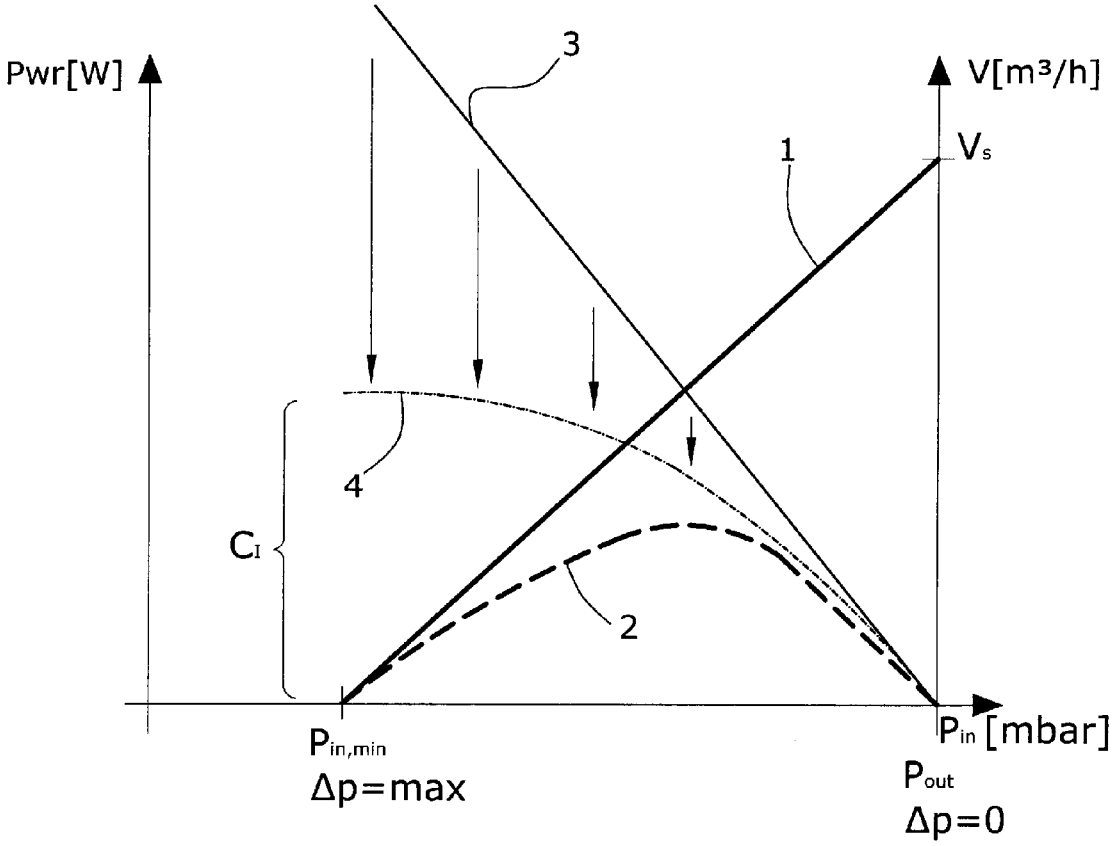
FIG. 2 is a power diagram of the displacement pump device of FIG. 1.

In FIG. 2, the inlet pressure $P_{in}$ is plotted in millibar on the horizontal axis, the volume flow V is plotted on the right vertical axis in cubic meters per hour, and the resulting power Pwr is plotted in Watt on the left vertical axis. In the embodiment illustrated, the displacement pump 10 is used in the rough pumping mode to generate a rough vacuum. Here, approximately atmospheric pressure prevails at the pump outlet 20, i.e. $P_{out}$ is 1000 mbar. The pressure $P_{in,min}$ to be generated by the pump at the pump inlet 18 is 700 mbar, i.e. the differential pressure $\Delta P_{max}=P_{out}-P_{in,min}$ to be obtained is 300 mbar. Of course, the pump may also be used to generate an inlet pressure $P_{in}$ of 1300 mbar, in which case the differential pressure $\Delta P_{max}$ to be generated amounts to 300 mbar.

In FIG. 2, the reference numeral 1 identifies the volume flow V obtained in the displacement pump 10 during the operation for reaching the inlet pressure $P_{in,min}$. When the pump starts, atmospheric pressure still prevails at the inlet side, i.e. $P_{in}=P_{out}$. In this case, the resulting differential pressure is $\Delta P=P_{out}-P_{in}=0$. The volume flow V in the pump is at the maximum, i.e. equal to the volume flow capacity $V_S$ of the displacement pump 10. As the pressure $P_{in}$ on the inlet side drops, the volume flow V conveyed decreases linearly until the inlet pressure $P_{in,min}=700$ mbar is reached. The maximum differential pressure to be generated, i.e. $\Delta P_{max}=P_{out}-P_{in,min}=300$ mbar, is then reached and the volume flow conveyed by the displacement pump 10 is V=0.

Here, the pump power of the displacement pump 10 is proportional to the differential pressure ΔP and has been given the reference numeral 3 in FIG. 2. With an inlet pressure $P_{in}=P_{out}$ and a resulting differential pressure ΔP=0, the pump power 3 is zero. It rises linearly up to its maximum for an obtained inlet pressure $P_{in}=P_{in,min}$ and a resulting differential pressure $\Delta P_{max}=P_{out}-P_{in,min}$.

The power physically required for compressing the gas in order to establish the differential pressure $\Delta P_{max}$, is calculated from the relationship $$\mathrm{Pwr}=V\cdot\Delta P=V\cdot(P_{out}-P_{in}).$$

This yields the minimum input power of the displacement pump 10 physically required for compressing the gas in order to establish the differential pressure $\Delta P_{max}$. In FIG. 2, this physical minimum input power is identified by the reference numeral 2. For a minimum differential pressure ΔP=0 and for a minimum volume flow V=0, it is zero, respectively, and follows a hyperbolic course with a maximum for $P_{in,min}<P_{in}<P_{out}$.

By comparing the maximum capacity 3 of the displacement pump 10 with the physical minimum input power 2, it becomes clear that the difference between these two powers increases as the inlet pressure $P_{in}$ falls and that it is substantial especially with large differential pressures near $\Delta P_{min}$. With smaller differential pressures near ΔP=0, however, the pump's capacity 3 is only slightly higher than the physically required minimum power 2. At low differential pressures ΔP, the displacement pump 10 thus operates most efficiently and becomes ever less efficient as the differential pressures rise. This is the reason why displacement pumps 10 have been used heretofore only to establish or maintain rather small differential pressures. For large differential pressures, as typically occur in rough pumping, displacement pumps have hitherto been ignored because of their low efficiency. Instead, side channel compressors are typically used in the rough pumping domain, which, however, have the disadvantage that they must continuously be driven at a constant rotational speed to reach their suction capacity. Therefore, a rotational speed control for improving the efficiency of pumps has been no option at all in the field of rough pumping.

The invention is based on the principle that displacement pumps convey a fixedly contained volume, the rotational speed of the displacement pump having no influence on the respective contained volume conveyed. With displacement pumps, the rotational speed merely influences the capacity of the conveyed contained volume. The invention uses this advantage in order to avoid operating an inherently over-capable displacement pump 10 with an over-capable capacity 3, but instead to approximate the pumping power 3, 4 to the minimum physically required input power 2 by reducing the rotational speed of the displacement pump 10. Hitherto, this has not been possible with known rough vacuum pumps, such as side channel compressors, for example.

The pump rotational speed is reduced by lowering the rotational speed of the electric motor 12 using the inverter 14. In this case, the pump rotational speed Ω, is adjusted through the relationship $$\Omega = \frac{C_I}{V_S}\left(\frac{P_{out}}{P_{in}} - 1\right)\Omega_{max}.$$

$P_{in}$ is the respective prevailing suction-side pressure at the inlet side 18 of the displacement pump 10. At the start of the pump $P_{in}=P_{out}$, so that $\Delta P=0$. As the inlet pressure $P_{in}$ falls, the back leakage caused by leakages within the pump rises. Here, $C_I$ is the associated back leakage conductance in cubic meters per hour. The back leakage conductance $C_I$ is calculated from $$C_I=(P_{in}\cdot V_S-Q)/(P_{out}-P_{in}),$$

where Q is the mass flow rate in millibar by cubic meters per hour. The mass flow rate Q is calculated from $$Q=P_{in}\cdot V_S-C_I(P_{out}-P_{in}).$$

Starting from the capacity 3 of the displacement pump 10

$$\text{Pwr}=V_S\cdot(P_{out}-P_{in})$$

the reduced rotational speed Ω for an approximation to the minimum physical input power 2 is determined as follows:

The volume flow capacity $V_S$ of the displacement pump is given and is 420 $m^3$/h for the Roots pump of the embodiment. Typically, the capacity of rough vacuum glowers ranges from 1 to 2000 $m^3$/h. The outlet pressure $P_{out}$ is given as an atmospheric pressure of 1000 mbar so that the pumping power 3 increases as the inlet pressure $P_{in}$ falls. While the inlet pressure $P_{in}$ falls, the influence of the back leakage conductance $C_I$ within the pump increases. The volume flow capacity $V_S$=420 $m^3$/h is reached at the maximum rotational speed $\Omega_{max}$=100 Hz. By reducing the rotational speed, a reduced volume flow capacity of $$\frac{V_S\cdot\Omega}{\Omega_{max}}$$

can be achieved.

The pump torque T is calculated from $$T=\text{Pwr}/\Omega$$

and with consideration to $$\text{Pwr}=V_S\cdot\Delta P/36.$$

for the reduced torque, thus yielding $$T = \frac{V_S}{\Omega_{max}}\cdot(P_{out} - P_{in})/36.$$

It is obvious from the above that the inlet pressure $P_{in}$ depends on the torque T applied. This correlation can be employed by using the inherent current control of an electronic inverter 14 to control the torque T by controlling the current in an electric motor 12. Using the inverter 14, the torque T of the pump drive 12 is continuously reduced above a limit rotational speed $\Omega_{v/f}$ of 10 Hz as the differential pressure ΔP and the pump rotational speed rise. The torque band of the inverter is constant up to the limit rotational speed $\Omega_{v/f}$ and, above this limit rotational speed $\Omega_{v/f}$, falls linearly to 0 at a constant rate. This is advantageous since the torque, according to the above equation, depends on the inlet pressure $P_{in}$ so that only a certain torque is required to reach a certain input pressure $P_{in}$.

Since the power P, being the product of torque T and rotational speed Ω, also depends on the pump rotational speed, the rotational speed Ω of the displacement pump 10 is first set such that the minimum inlet pressure $P_{in,min}$ is reached at the lowest rotational speed Ω possible so as to minimize the pumping power 3, 4 to be applied. When the displacement pump 10 is operated at this reduced rotational speed Ω, the above described torque band is then used with a continuously decreasing torque in order to approximate the power input 4 of the displacement pump 10 to the minimum power 2 physically required.

At a minimum inlet pressure $P_{in,min}$, with the volume flow being V=0, the inlet pressure is $$P_{in} = P_{in,min} = P_{out} - \left(\frac{36T\Omega_{max}}{V_S}\right).$$

Taking into account the back leakage conductance $C_I$, the following applies if the volume flow is V=0

$$P_{in} = (C_I\cdot P_{out})\Big/\left(\frac{V_S\cdot\Omega}{\Omega_{max}} + C_I\right).$$

From this, the rotational speed Ω can be calculated, for which the pumping power, with consideration to the back leakage conductance $C_I$ due to leakages within the pump, approximates the minimum physical inlet power 2. Here, $P_{in}$ is the approximated pump inlet pressure 4 that differs from the minimum physical inlet power 2 by the back leakage conductance $C_I$ within the pump. In FIG. 2, the approximated pump inlet power has been given the reference numeral 4. The approximated pump inlet power 4 is reached at the rotational speed $$\Omega = \frac{C_I}{V_S}\left(\frac{P_{out}}{P_{in,min}} - 1\right)\Omega_{max}.$$

As illustrated in FIG. 2, the reduced pump inlet power 4 has clearly approximated the minimum physical inlet power 2 as compared to the pumping power 3 at the maximum rotational speed $\Omega_{max}$ of the displacement ump 10. In other words: the displacement pump 10 operates clearly more effective at the reduced rotational speed Ω than at the maximum rotational speed $\Omega_{max}$. A correspondingly over-capable displacement pump 10 operated at a reduced rotational speed Ω as defined in the above relationship operates more effectively than a conventional rough vacuum pump such as a side channel compressor, for example.

Although the invention has been described and illustrated with reference to specific illustrative embodiments thereof, it is not intended that the invention be limited to those illustrative embodiments. Those skilled in the art will recognize that variations and modifications can be made without departing from the true scope of the invention as defined by the claims that follow. It is therefore intended to include within the invention all such variations and modifications as fall within the scope of the appended claims and equivalents thereof.

The invention claimed is:

1. A rough pumping method for a displacement pump, configured to generate a maximum differential pressure between an inlet and an outlet of the displacement pump, a rotational speed (Ω) of the displacement pump being adjusted to a maximum differential pressure to be generated such that a power input of the displacement pump approximates a minimum power physically required for compressing a pumped gas in order to establish the maximum differential pressure, wherein the rotational speed (Ω) for reaching the maximum differential pressure is set using a relationship $$\Omega = \frac{C_I}{V_S}\left(\frac{P_{out}}{P_{in,min}} - 1\right)\Omega_{max},$$

wherein $V_S$ is the compressor swept capacity of the displacement pump, $C_I$ is the back-leakage conductance within the pump, $P_{out}$ is the outlet pressure of the displacement pump, $P_{in,min}$ is the minimum inlet pressure of the displacement pump that is to be generated, $\Delta P_{max}=P_{out}-P_{in,min}$, and $\Omega_{max}$ is the maximum rotational speed of the displacement pump with $\Omega<\Omega_{max}$.

2. The rough pumping method of claim 1, wherein a ratio of an outlet pressure to an inlet pressure of the displacement pump at the maximum possible rotational speed of the displacement pump is greater than 3.

3. The rough pumping method of claim 2, wherein the ratio of the outlet pressure to the inlet pressure has a maximum value of 10.

4. The rough pumping method of claim 1, wherein a magnitude of the differential pressure to be generated is in a range of up to 1000 mbar.

5. The rough pumping method of claim 4, wherein the magnitude of the differential pressure to be generated is in a range of up to 500 mbar.

6. The rough pumping method of claim 5, wherein the magnitude of the rough differential pressure is in a range from 200 and 400 mbar.

7. The rough pumping method of claim 1, wherein the displacement pump is a Roots pump, a claw screw pump, or a dry running rotary vane pump.

8. The rough pumping method of claim 1, wherein the displacement pump is a multi-stage displacement pump comprising at least two pumping stages.

9. A rough pumping method for a displacement pump, comprising:

controlling a pump drive to adjust a rotational speed of the displacement pump such that a maximum differential pressure is generated between an inlet and an outlet of the displacement pump, above a selected rotational speed ($\Omega_{V,f}$), continuously reducing a torque of the pump drive as the differential pressure and the pump rotational speed increase, where $0\leq\Omega_{V,f}\leq 30$ Hz, such that a power input of the displacement pump approximates a minimum power physically required for compressing a pumped gas in order to establish the maximum differential pressure.

10. The rough pumping method of claim 9, wherein the torque is reduced by using an electronic inverter in an electric motor serving as the pump drive.

11. The rough pumping method of claim 10, wherein the electric motor is an inductance motor, a reluctance motor or a brushless DC motor.

12. A displacement pump for establishing a rough differential pressure between an inlet and an outlet of a displacement pump, comprising:

a pump drive for adjusting a rotational speed (Ω) of the displacement pump to a maximum differential pressure to be generated such that a power input of the pump approximates a minimum power physically required for compressing a pumped gas in order to establish the maximum differential pressure; and a pump drive controller configured to control the rotational speed (Ω) of the pump drive using the relationship $$\Omega = \frac{C_I}{V_S}\left(\frac{P_{out}}{P_{in,min}} - 1\right)\Omega_{max},$$

wherein $V_S$ is a compressor swept capacity of the displacement pump, $C_I$ is a back-leakage conductance within the pump, $P_{out}$ is an outlet pressure of the displacement pump, $P_{in,min}$ is a minimum inlet pressure of the displacement pump that is to be generated, $\Delta P_{max}=P_{out}-P_{in,min}$, and $\Omega_{max}$ is a maximum rotational speed of the displacement pump with $\Omega<\Omega_{max}$.

13. A displacement pump device for establishing a rough differential pressure between an inlet and an outlet of a displacement pump, comprising:

a pump drive for adjusting a rotational speed of the displacement pump to increase a differential pressure between the inlet and the outlet to a selected maximum rough differential pressure to be generated;

a pump drive controller configured to, above a lower limit rotational speed, continuously reduce a torque of the pump drive as the differential pressure and the pump rotational speed increase;

such that a power input of the pump approximates a minimum power physically required for compressing a pumped gas in order to establish the maximum differential pressure.

14. The displacement pump device of claim 13, further including:

a memory for storing the selected differential pressure to be generated.

15. The displacement pump device of claim 13, wherein at an upper limit rotational speed, the displacement pump has a ratio of an outlet pressure to an inlet pressure greater than 3.

16. The displacement pump device of claim 15, wherein the ratio of the outlet pressure to the inlet pressure has a maximum value of 10.

17. The displacement pump device of claim 13, wherein a magnitude of the rough differential pressure to be generated is in a range of up to 1000 mbar.

18. The displacement pump device of claim 13, wherein a magnitude of the rough differential pressure to be generated is in a range of up to 500 mbar.

19. The displacement pump device of claim 18, wherein the magnitude of the rough differential pressure is in a range from 200 and 400 mbar.

20. The displacement pump device of claim 13, wherein the pump drive includes an electronic motor and an electronic inverter.

21. The displacement pump device of claim 20, wherein the electric motor is one of an inductance motor, a reluctance motor, and a brushless DC motor.

22. The displacement pump device of claim 13, wherein the displacement pump is one of a Roots pump, a claw screw pump, and a dry running rotary vane pump.

23. The displacement pump device of claim 13, wherein the displacement pump is a multi-stage displacement pump comprising at least two pump stages.

* * * * *